US006585205B2

(12) United States Patent
Beaty et al.

(10) Patent No.: US 6,585,205 B2
(45) Date of Patent: Jul. 1, 2003

(54) FORCE DISTRIBUTING MULTI-PIECE HINGED HANGER

(75) Inventors: Alan Keith Beaty, San Antonio, TX (US); Wallace Andrew Pennington, 6915 Wright Way St., San Antonio, TX (US) 78240

(73) Assignee: Wallace Andrew Pennington, San Antonio, TX (US)

( * ) Notice: Subject to any disclaimer, the term of this patent is extended or adjusted under 35 U.S.C. 154(b) by 0 days.

(21) Appl. No.: 10/299,316

(22) Filed: Nov. 19, 2002

(65) Prior Publication Data

US 2003/0071182 A1 Apr. 17, 2003

Related U.S. Application Data

(62) Division of application No. 09/631,704, filed on Aug. 3, 2000.

(51) Int. Cl.[7] ..... A47F 7/14

(52) U.S. Cl. ..... 248/218.1; 248/303; 248/475.1

(58) Field of Search ..... 248/217.1, 218.1, 248/302, 303, 475.1, 220.21, 220.22, 222.51, 222.52, 308, 294.1, 339, 216.1, 216.4, 217.2, 497, 498; 40/745, 761

(56) References Cited

U.S. PATENT DOCUMENTS

| | | | | | |
|---|---|---|---|---|---|
| 299,155 | A | | 5/1884 | McGill | |
| 365,882 | A | | 7/1887 | Taylor | |
| 392,624 | A | | 11/1888 | Miles | |
| 1,115,800 | A | | 11/1914 | Froberg | |
| 1,210,610 | A | | 1/1917 | Dehn | |
| 1,227,597 | A | * | 5/1917 | Ellis | 248/115 |
| 1,248,363 | A | | 11/1917 | Malcomson | |
| 1,445,372 | A | | 2/1923 | Wagner | |
| 1,802,934 | A | | 4/1931 | Balck | |
| 2,055,442 | A | | 9/1936 | Jones | |
| 2,066,814 | A | | 1/1937 | Williams | |
| 2,510,646 | A | * | 6/1950 | Meers | 224/265 |
| 2,640,672 | A | | 6/1953 | Bedford, Jr. | |
| 2,778,588 | A | * | 1/1957 | Capocci | 248/112 |
| 2,988,315 | A | | 6/1961 | Saxe | |
| 3,216,680 | A | | 11/1965 | Mosante | |
| 3,219,302 | A | * | 11/1965 | Smith | 248/218.3 |
| 3,715,096 | A | | 2/1973 | Filbert | |
| 4,362,249 | A | | 12/1982 | Thalenfield | |
| 4,422,608 | A | | 12/1983 | Hogg | |
| 4,619,430 | A | | 10/1986 | Hogg | |
| 4,664,350 | A | | 5/1987 | Dodds et al. | |
| D317,858 | S | | 7/1991 | Hoskinson et al. | |
| 5,029,788 | A | | 7/1991 | Hoskinson et al. | |
| D322,388 | S | | 12/1991 | Hoskinson et al. | |
| 5,112,177 | A | | 5/1992 | Chamings | |
| 5,393,184 | A | | 2/1995 | Beeuwkes, III | |
| 5,507,545 | A | | 4/1996 | Krysiak | |
| 5,878,988 | A | | 3/1999 | Rakower | |
| 5,967,476 | A | | 10/1999 | Chen | |
| 6,036,149 | A | | 3/2000 | Del Pino | |
| 6,126,126 | A | * | 10/2000 | McKiernan, Jr. | 248/217.3 |

FOREIGN PATENT DOCUMENTS

| | | | | |
|---|---|---|---|---|
| CH | 36200 | * | 7/1906 | 248/217.1 |
| CH | 92855 | * | 2/1922 | 248/218.1 |
| DE | 2944524 A1 | * | 5/1981 | 248/218.1 |

* cited by examiner

*Primary Examiner*—Ramon O. Ramirez
*Assistant Examiner*—Jon Szumny
(74) *Attorney, Agent, or Firm*—Michelle Evans; Gunn, Lee & Hanor, P.C.

(57) ABSTRACT

A hanger having a fixed pin assembly and a hinged pin assembly. Left and right vertical portions of fixed pin assembly are used to pin the hanger into the inner core of the applicable fabric-covered wall or furniture. Once the left and right vertical portions are inserted, the hinged pin assembly will rotate freely allowing the left and right lower angled portion to penetrate the fabric exterior surface and the inner core. At the central portion of the hinged pin assembly is a prong.

8 Claims, 1 Drawing Sheet

FORCE DISTRIBUTING MULTI-PIECE HINGED HANGER

This is a divisional patent application of U.S. patent application Ser. No. 09/631,704 filed on Aug. 3, 2000.

BACKGROUND OF THE INVENTION

1. Field of the Invention

Applicant's invention relates to a hanging apparatus for attaching objects to fabric covered walls or furniture. More specifically, the present invention relates to a hanging apparatus used on modular office systems furniture, sofas, chairs, vehicle seats, and sun visors.

2. Background Information

Hanging objects, particularly picture frames, on fabric-covered walls or furniture is difficult with prior art hangers because existing hangers do not securely attach to both the fabric exterior surface and the inner core material of the wall or furniture. Additionally with the prior art, hanging forces are not dispersed into multiple angles of incidence to the wall or furniture, nor are they supported by multiple or dispersed penetration points into the wall or furniture. These dispersion problems with the prior art cause the prior art fabric-covered wall and furniture hangers to pull the fabric exterior surface away from the inner core material and/or cause a sagging condition in the fabric.

Picture hangers have formerly attained commercial success by fastening securely to the inner surface of a wall or object without unduly damaging its exterior surface. However, these devices developed to secure objects to soft wall surfaces do not mitigate the hazard of surface tearing because they may detach from a wall's inner core material and hang on the fabric exterior surface causing it to rip. Additionally these prior art hangers do not provide adequate support for heavier objects. All hanging object weight in the prior art is distributed solely onto the fabric exterior surface and the weight is centralized at only one or two penetration points. Accordingly, the weight bearing capacity of the prior art is low and the possibility of damaging the fabric exterior surface in the prior art is high.

Pins are also known in the prior art that can pierce fabric. These pins have a wire bend protruding from the fabric for hanging objects. Prior art also contains plastic plates with long wire pins that attach to the surface material of a fabric-covered wall with a hook molded onto the plastic. The present invention has an entirely different design consisting of a prong which is hinged and cantilevered with a range of uses including attachment to plaques or pictures. The prior art hooks are not applicable to plaques or pictures because they are too wide to insert into the hole drilled into the plaque or picture backing. Furthermore, U.S. Pat. No. 5,029,788 issued to Hoskinson, et al and U.S. Pat. No. 4,664,350 issued to Dodds, et al are specifically designed to attach to the surface only with two or less entry points without hinges or levers to increase adhesion when weight on the hanger is increased. These prior art inventions still do not solve the problems that exist with attaching a hanging device to a fabric covered wall or furniture. The present invention; however, does solve these problems.

SUMMARY OF THE INVENTION

It is an object of the present invention to provide a novel hanger that can be attached to fabric-covered surfaces without pulling the fabric exterior surface away from the inner core material.

Still another object of the present invention is to provide a novel hanger that can be attached to fabric-covered surfaces without causing sagging.

Another object of the present invention is to provide a novel hanger that can be attached to fabric-covered surfaces without ripping the fabric exterior surface.

It is yet another object of the present invention to provide a novel hanger that binds to both the inner core material and the fabric exterior surface of fabric-covered surfaces.

Still another object of the present invention is to provide a novel hanger that can be attached quickly and safely by first time users with little or no instruction.

It is still another object of the present invention to provide a novel hanger that securely attaches to both the inner core material and fabric exterior surface while providing the maximum amount of protection to the fabric exterior surface.

Still another object of the present invention is to provide a novel hanger whereby the hanging forces are imparted mostly to the inner core material by piercing the inner core material in a perpendicular plane with hinge pins while lower pins are used to penetrate the fabric exterior surface and distribute force in another plane perpendicular to the first thereby preventing movement of the present hanger.

Another object of the present invention is to provide a novel hanger that creates more piercing force to the inner core material when more weight is added to the prong.

In satisfaction of these and related objectives, Applicant's present invention provides for a hanger having a fixed pin assembly and a hinged pin assembly. Left and right vertical portions of fixed pin assembly are used to pin the hanger into the inner core of the applicable fabric-covered wall or furniture. Once the left and right vertical portions are inserted, the hinged pin assembly will rotate freely allowing the left and right lower angled portion to penetrate the fabric exterior surface and the inner core. At the central portion of the hinged pin assembly is a prong.

DETAILED DESCRIPTION OF THE PREFERRED EMBODIMENT

Figure 1:
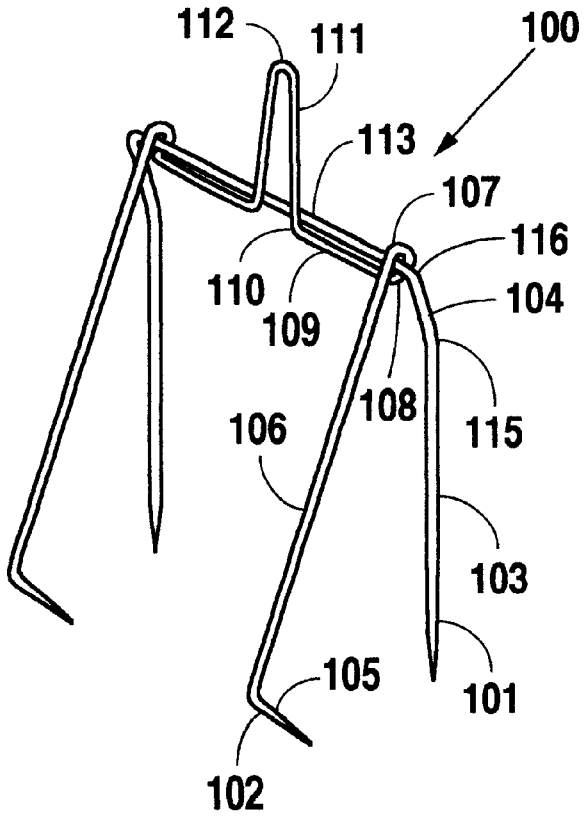
FIG. 1 is a perspective view of the preferred embodiment of the present invention.

In FIG. 1 a perspective view of the preferred embodiment of the present hanger 100 is shown. The hanger 100 of the present invention is generally composed of two major parts being a fixed pin assembly 101 and a hinged pin assembly 102. The fixed pin assembly 101 which is generally U-shaped is provided with a left and right vertical portion 103, left and right angled portion 104 and horizontal portion 113. Left and right vertical portion 103, being pointed at one end, are continuous through left and right angled portion 104 by way of left and right first elbow 115, respectively, and left and right angled portion 104 are continuous through horizontal portion 113 by way of left and right second elbow 116, respectively.

The second major component of the hanger 100 of the present invention is the hinged pin assembly 102. The hinged pin assembly 102 is generally positioned in front of fixed pin assembly 101 and is moveable with respect to fixed pin assembly 101. Hinged pin assembly 102 is composed of left and right lower angled portion 105, being pointed at one end, which join left and right vertical portion 106, respectively. Hinged pin assembly 102 overlaps fixed pin assembly 101 at left and right loop portion 107 forming generally a hinge mechanism whereby horizontal portion 113 of fixed pin assembly 101 is positioned through left and right opening 108. Left and right loop portion 107 are continuous with left and right lower horizontal portion 109, respectively. Left and right lower horizontal portion 109 connects with left and right rising portion 111, respectively, by way of left and right lower elbow 110. Left and right rising portion 111 terminate in prong 112, which is generally U-shaped.

Figure 2:
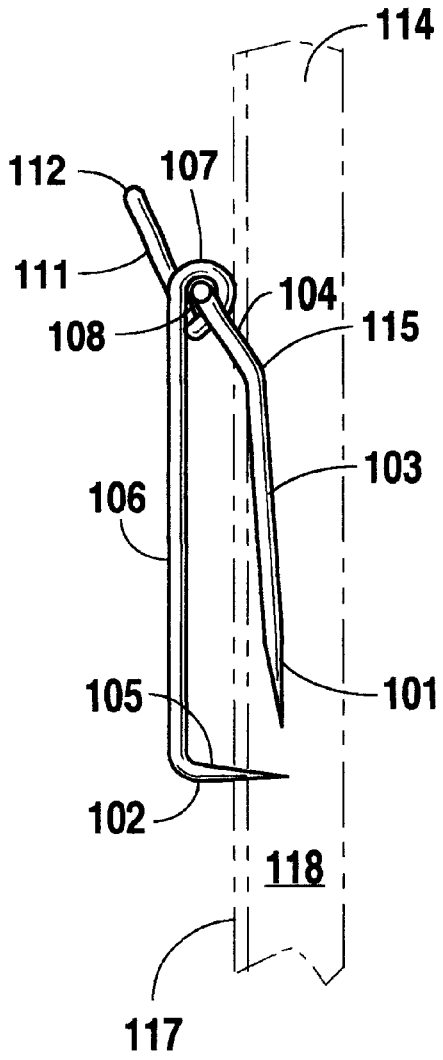
FIG. 2 is a side view of the preferred embodiment of the present invention.

FIG. 2 is a side view of the preferred embodiment of the present invention shown inserted into a fabric covered wall or furniture 114. The present hanger 100 is attached to fabric covered walls or furniture 114 by pressing the pointed end of left and right vertical portion 103 of fixed pin assembly 101 in a downward direction into the inner core 118 of the fabric covered wall or furniture 114 up to left and right first elbow 115. Left and right angled portion 104 will extend through exterior surface 117 of the fabric covered wall or furniture 114. Left and right loop portion 107 will abut exterior surface 117 of the fabric covered wall or furniture 114.

Once this is accomplished, the hinged pin assembly 102 is then moved relative to the fixed pin assembly 101 which brings the pointed end of left and right lower angled portion 105 in contact with the surface of the fabric covered walls or furniture 114. The thumb of the user can then be placed against the present hanger 100 and left and right lower angled portion 105 are forced through the exterior surface 117 of the fabric covered wall or furniture 114 and into the inner core 118 anchoring the present hanger 100 into the fabric covered wall or furniture 114.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A force distributing hanger for a fabric-covered wall or furniture having a fabric exterior surface and an inner core material, said hanger comprising:

a fixed pin assembly being U-shaped and having a left and right vertical portion with pointed ends for insertion into said inner core material of said fabric covered wall or furniture, wherein said fixed pin assembly further comprises a left and right angled portion connected to said left and right vertical portions and wherein said fixed pin assembly further comprises a left and right elbow connecting said left and right angled portions to said left and right vertical portions; and a hinged pin assembly associated by way of a hinge mechanism with said fixed pin assembly and having a left and right lower angled portion with pointed ends for insertion into said inner core material of said fabric covered wall or furniture, said hinged pin assembly further comprising a prong;

whereby when said left and right vertical portions of said fixed pin assembly are inserted into said inner core material of said fabric covered wall or furniture, said hinged pin assembly moves relative to said fixed pin assembly which brings said pointed ends of said left and right lower angled portions into contact with said fabric covered wall or furniture for penetration into said fabric covered wall or furniture.

2. The force distributing hanger for a fabric-covered wall or furniture having a fabric exterior surface and an inner core material of claim 1 wherein said fixed pin assembly further comprises a horizontal portion connected to said left and right angled portion.

3. The force distributing hanger for a fabric-covered wall or furniture having a fabric exterior surface and an inner core material of claim 2 wherein said fixed pin assembly further comprises a left and right second elbow connecting said left and right angled portions to said horizontal portion.

4. The force distributing hanger for a fabric-covered wall or furniture having a fabric exterior surface and an inner core material of claim 3 wherein said hinged pin assembly is located in front of said fixed pin assembly.

5. The force distributing hanger for a fabric-covered wall or furniture having a fabric exterior surface and an inner core material of claim 4 wherein said hinged pin assembly further comprises a left and right vertical portion connected to said left and right lower angled portions.

6. The force distributing hanger for a fabric-covered wall or furniture having a fabric exterior surface and an inner core material of claim 5 wherein said hinged pin assembly overlaps said fixed pin assembly at a left and right loop portion.

7. The force distributing hanger for a fabric-covered wall or furniture having a fabric exterior surface and an inner core material of claim 6 wherein said hinged pin assembly further comprises a left and right lower horizontal portion connected to said left and right loop portions.

8. The force distributing hanger for a fabric-covered wall or furniture having a fabric exterior surface and an inner core material of claim 7 wherein said hinged pin assembly further comprises a left and right rising portion which connects to said left and right lower horizontal portions.

* * * * *